US007444787B2

(12) United States Patent
Cutforth

(10) Patent No.: US 7,444,787 B2
(45) Date of Patent: Nov. 4, 2008

(54) CONCRETE POST ANCHOR

(75) Inventor: Jack F. Cutforth, Mexico, MO (US)

(73) Assignee: Concrete Pier System, LLC., Mexico, MO (US)

( * ) Notice: Subject to any disclaimer, the term of this patent is extended or adjusted under 35 U.S.C. 154(b) by 145 days.

(21) Appl. No.: 11/673,822

(22) Filed: Feb. 12, 2007

(65) Prior Publication Data

US 2007/0125022 A1 Jun. 7, 2007

Related U.S. Application Data

(63) Continuation-in-part of application No. 11/079,806, filed on Mar. 14, 2005.

(51) Int. Cl.
*E02D 27/42* (2006.01)
*E04H 12/22* (2006.01)

(52) U.S. Cl. ..... 52/295; 52/296; 52/297; 52/298; 52/299; 52/707; 52/708

(58) Field of Classification Search ..... 52/294, 52/295, 296, 297, 298, 169.3, 170, 707, 708, 52/165, 704, 9.1, 91.22
See application file for complete search history.

(56) References Cited

U.S. PATENT DOCUMENTS

| | | | | | |
|---|---|---|---|---|---|
| 284,219 | A | * | 9/1883 | Mehew | 52/154 |
| 887,217 | A | * | 5/1908 | Oliphant | 52/295 |
| 1,811,899 | A | * | 6/1931 | Spring | 52/170 |
| 1,979,580 | A | * | 11/1934 | Spring | 52/170 |
| 2,110,863 | A | * | 3/1938 | Barnett | 52/101 |
| 3,413,773 | A | | 12/1968 | Fitzgerald | |
| 4,117,643 | A | | 10/1978 | Lamothe | |
| 4,192,118 | A | * | 3/1980 | Gilb | 52/714 |
| 4,199,908 | A | * | 4/1980 | Teeters | 52/295 |
| 4,202,149 | A | | 5/1980 | Betrue, Sr. | |
| 4,272,929 | A | | 6/1981 | Hanson | |
| 4,312,160 | A | | 1/1982 | Wilbanks | |
| 4,387,543 | A | | 6/1983 | Tschan | |
| 4,434,600 | A | * | 3/1984 | Backman | 52/742.15 |

(Continued)

OTHER PUBLICATIONS

Midwest Perma-Column, Inc. (PCI), "The Permanent Solution" Brochure www.permacolumn.com.

*Primary Examiner*—Robert J Canfield
*Assistant Examiner*—Ryan J Franks
(74) *Attorney, Agent, or Firm*—McKee, Voorhees & Sease, P.L.C.

(57) ABSTRACT

The current invention is a concrete post anchor and method of using comprising two substantially vertical side brackets, side brackets operatively connected opposite one another and spaced apart with a base bracket and a back bracket forming a U-shaped bracket. A pair of front brackets is removably attached to the side brackets. An anchor and a portion of the side brackets extend below the base bracket forming an anchor tab and a side bracket tab. A pair of anchor rods is operatively connected to each side bracket tab. The anchor can be embedded in a concrete pier and then a post can be secured within the concrete post anchor with the front brackets and fastened to the anchor. The concrete post anchor withstands increased loads and forces associated with post built-type buildings without permitting the wood post to directly contact the soil, thereby creating substantially stronger and longer-lasting post buildings.

15 Claims, 8 Drawing Sheets

U.S. PATENT DOCUMENTS 4,455,795 A * 6/1984 Cole ..... 52/155
4,644,713 A * 2/1987 Lehman ..... 52/165
4,872,298 A 10/1989 Klemic, Jr.
4,923,165 A * 5/1990 Cockman ..... 248/545
4,924,648 A * 5/1990 Gilb et al. ..... 52/295
5,203,817 A 4/1993 Kilumpjan
5,337,534 A 8/1994 Nasca
5,375,384 A * 12/1994 Wolfson ..... 52/295
5,501,048 A * 3/1996 Nakanishi ..... 52/296
5,575,130 A * 11/1996 Chiodo ..... 52/713
5,666,774 A * 9/1997 Commins ..... 52/298
5,699,639 A * 12/1997 Fernandez ..... 52/707
5,740,645 A 4/1998 Raby
5,749,189 A * 5/1998 Oberg ..... 52/298
5,765,333 A 6/1998 Cunningham
5,901,525 A * 5/1999 Doeringer et al. ..... 52/835
5,966,882 A * 10/1999 Naito ..... 52/295
5,970,677 A * 10/1999 Masters et al. ..... 52/712
6,513,290 B2 2/2003 Leek
6,658,806 B1 12/2003 Leek
6,964,139 B2 11/2005 Meyer et al.
7,137,228 B2 * 11/2006 Wagner ..... 52/295
7,168,343 B2 * 1/2007 Leek et al. ..... 81/176.1
7,287,355 B2 * 10/2007 Commins ..... 52/223.14
7,296,386 B2 * 11/2007 Leek ..... 52/296
2002/0066247 A1 * 6/2002 Leek ..... 52/295
2003/0136068 A1 7/2003 Forbis et al.
2006/0037265 A1 * 2/2006 Leek ..... 52/295
2006/0067794 A1 * 3/2006 Mitchell ..... 405/230
2006/0275085 A1 * 12/2006 Ong ..... 405/230
2007/0084137 A1 * 4/2007 Pasto ..... 52/170

* cited by examiner

CONCRETE POST ANCHOR

CROSS-REFERENCE TO RELATED APPLICATION

This application is a Continuation-in-Part application of U.S. application Ser. No. 11/079,806 filed Mar. 14, 2005, which is hereby incorporated by reference in its entirety.

BACKGROUND OF THE INVENTION

This invention relates to an improved apparatus and method for constructing pole buildings. Specifically, this invention relates to an improved concrete post anchor.

Pole buildings have been in use for many years. The popularity of these buildings has risen due to their economical nature in manufacturing.

Typically, pole buildings are constructed with large wooden poles extending upward from the ground which are connected together with stringers and then sided with a sheet metal siding. In addition, roof beams or trusses are put across the top of the wooden poles and a roof is then applied to the building. As mentioned, this type of building is economical to construct. However, one problem with this type of building is that when the wooden poles are in contact with the earth, the wooden poles invariably rot off and shorten the life of the building.

Many people have tried to remedy this problem. One such remedy is using pretreated or pressure treated lumber. Pressure treated lumber is treated with poisonous chemicals which prevents bugs and worms from tunneling into the wood, thus reducing premature failure of the pole. However, eventually the acids in the soils of the earth decompose the wood and the building still has a premature failure.

Thus, it is desirable to have a method and apparatus for allowing construction of pole buildings where the wall support poles are not in direct contact with the soil.

The primary objective of the present invention is to provide an improved concrete post anchor.

Another objective of the present invention is to provide a concrete post anchor which can be imbedded into concrete at the building site.

Another objective of the present invention is a concrete post anchor which can easily be set to level and plumb so that uniform length posts can be fastened to the anchors and do not have to be trimmed once installed.

Another objective of the present invention is to reduce freight costs since the anchor itself has little weight and the concrete is brought and poured on site.

Another objective of the present invention is to create a safe concrete post anchor by not having to handle very heavy pre-made concrete post anchors.

A further objective of the present invention is to create a post anchor which is configured to reduce risks of cracking of concrete that it is embedded into.

A further objective of the present invention is to reduce chances of the concrete post anchor sinking in uncured concrete.

A further objective of the present invention is to create a pole building in which wooden poles do not directly contact the soil.

A further objective of the present invention is a concrete post anchor in which concrete piers, upon which concrete anchors are embedded into, are constructed with a reduced risk of shearing off.

A further objective of the present invention is to provide a concrete post anchor in which the chances are reduced for splitting out a wooden post fastened to the post anchor.

A further objective of the present invention is to create a post anchor with stronger anchor rods.

A still further objective of the present invention is a provision of a concrete post anchor which is economical to manufacture, durable in use, and efficient in operation.

A still further objective of the present invention is an improved post building.

A still further objective of the present invention is an improved method of constructing a post building.

A further objective of the present invention is to provide a concrete post anchor with improved load handling ability.

A still further objective of the present invention is to provide a concrete post anchor capable of supporting a longer and taller span of sidewall.

Another objective of the present invention is to provide a concrete post anchor having load handling capabilities that exceed the load handling capabilities of the wall post.

Another further objective of the present invention is to provide a pair of front brackets for tightly securing the post within the concrete post anchor.

One or more of these or other objectives of the invention will be apparent from the specification and claims that follow.

A still further objective of the present invention is to provide a U-shaped concrete post anchor where the open back side is partially enclosed by a back bracket and the open front side is partially enclosed by the front brackets.

SUMMARY OF THE INVENTION

The foregoing objects may be achieved by a concrete post anchor comprising a pair of substantially vertical side brackets, the side brackets operatively connected opposite one another and spaced apart with a base bracket and a back bracket to thereby form a U-shaped bracket with a partially enclosed back side, at least one front bracket removably attached to the side brackets, an anchor and a portion of the side brackets extend below the base bracket to form an anchor tab and a side bracket tab, and a pair of anchor rods operatively connected to each side bracket tab and extending away from the base bracket in a direction opposite the U-shaped bracket.

A further feature of the present invention wherein the anchor tab and side bracket tabs extend away from the base bracket in a direction opposite the U-shaped bracket.

A further feature of the present invention involves a concrete post anchor wherein the side brackets are welded or fastened to a base bracket and the back bracket.

A further feature of the present invention wherein the at least one front bracket is bolted to the side brackets.

A further feature of the present invention wherein a plurality of lugs are operatively attached to the side brackets for anchoring the at least one front bracket to the side brackets.

A further feature of the present invention involves a concrete post anchor wherein the anchor is formed from a single piece.

A further feature of the present invention is a concrete post anchor wherein side brackets are substantially parallel to one another.

A further feature of the present invention involves a concrete post anchor wherein side brackets are configured with a plurality of apertures to allow for fastening a wall post to the concrete post anchor.

A further feature of the present invention involves a concrete post anchor configured with a first aperture is located in a diagonal relationship to a second aperture to thereby resist splitting of a wood post when fasteners are inserted into the post through the plurality of apertures.

A further feature of the present invention is a concrete post anchor wherein an anchor rod is welded with a lap joint to the side bracket tabs.

A further feature of the present invention involves a concrete post anchor wherein the anchor tab, the side bracket tab and the anchor rod extend from the post anchor into a concrete pier so the concrete pier may be formed at a building site where the anchor is being used for constructing a building.

The foregoing objects may also be achieved by a pole building on a building site comprising a floor, side walls, and a roof; the roof supported by roof supports, the roof supports supported by wall posts, and the wall posts supported by a concrete post anchor. The concrete post anchor comprising a pair of substantially vertical side brackets; the side brackets operatively connected opposite one another and spaced apart with a base bracket and a back bracket to thereby form a U-shaped bracket having a partially enclosed back side. A pair of front brackets is removably attached to the side brackets. A portion of the side brackets extend below the base bracket forming a side bracket tab. And, at least one anchor rod is operatively connected to each side bracket tab so as to extend away from the base bracket in a direction opposite the U-shaped bracket.

A further feature of the present invention wherein an anchor tab is connected to the base bracket on the partially enclosed back side so as to extend away from the base bracket in a direction opposite the U-shaped bracket.

A further feature of the present invention involves a building wherein the concrete post anchor extends upward from and is embedded into a concrete pier.

A further feature of the present invention involves a building wherein concrete is poured and formed in the concrete piers on the building site for supporting the concrete post anchors.

The foregoing objects may also be achieved by a method of constructing a building on a building site comprising the steps of assembling a baseboard frame substantially around a perimeter of a desired building location on the building site, creating holes in the ground at locations where a wall post is desired to support a wall and a roof, affixing concrete pier forms to the baseboard above the holes in the ground, pouring concrete into the holes and forms, inserting at least one shear rod into the concrete before the concrete cures, inserting a post anchor into the concrete before the concrete cures, leveling the post anchors to approximately plumb before the concrete cures, positioning the wall post within the post anchor after the concrete cures, securing the wall post to the post anchor by attaching at least one front bracket to the post anchor, leveling the posts to approximately plumb, attaching roof supports between two wall posts across the desired building location, and attaching roofing to the roof supports and siding to the wall supports to substantially enclose the building.

A further feature of the present invention involves a method of constructing a building comprising the step of attaching an anchor height bracket to a baseboard above holes in the ground to keep a post anchor from sinking in uncured concrete which is poured into the post holes.

A further feature of the present invention involves a method of constructing a building comprising a step of attaching baseboard mounting screws to a baseboard above holes in the ground so that the screws will be located within concrete which is poured into the post holes and hold the baseboard to the concrete.

A further feature of the present invention involves a method of constructing a building comprising a step of removing forms from a concrete post pier once the concrete cures so that the forms can be reused.

Another feature of the present invention involves a method of constructing a building wherein the at least one front bracket is bolted to a pair of lugs on the post anchor for compressing and securing the wall post within the post anchor.

A still further feature of the present invention involves a method of constructing a building comprising the step of fastening the wall post to the post anchor with lag screws using a plurality of apertures in the post anchor.

This invention discusses a building wall post. It is contemplated that the building wall post can be a solid wooden post, a laminated post from solid boards, a laminated post from laminated boards, a metal post, or other similar building material rigid posts suitable for use to post buildings.

DETAILED DESCRIPTION OF THE PREFERRED EMBODIMENT

The current invention is an improved concrete post anchor and method of constructing a pole building using the same.

As with any building process, the first step is selecting a building site, clearing the building site, and leveling or grading the site to a substantially level grade. The grade on the site should be packed sufficiently so as to minimize settling of the ground after construction of the building.

Figure 1:
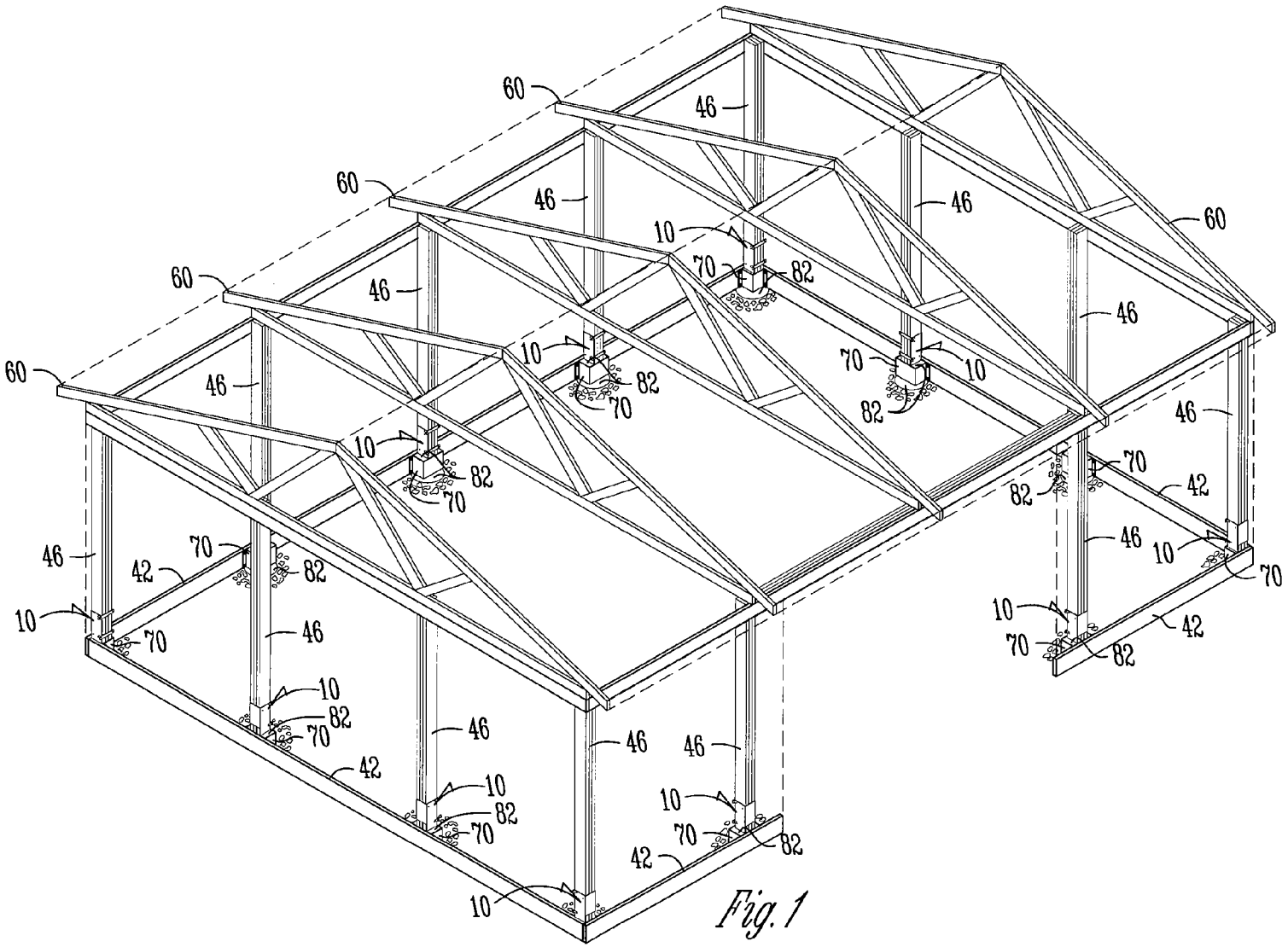
FIG. 1 is one embodiment of the structural framework of a pole building using the current invention.

FIG. 1 shows one embodiment of a building frame assembly 40 for the current invention. Once the building site is prepared, construction on the building can begin. This process will be described later.

Figure 2:
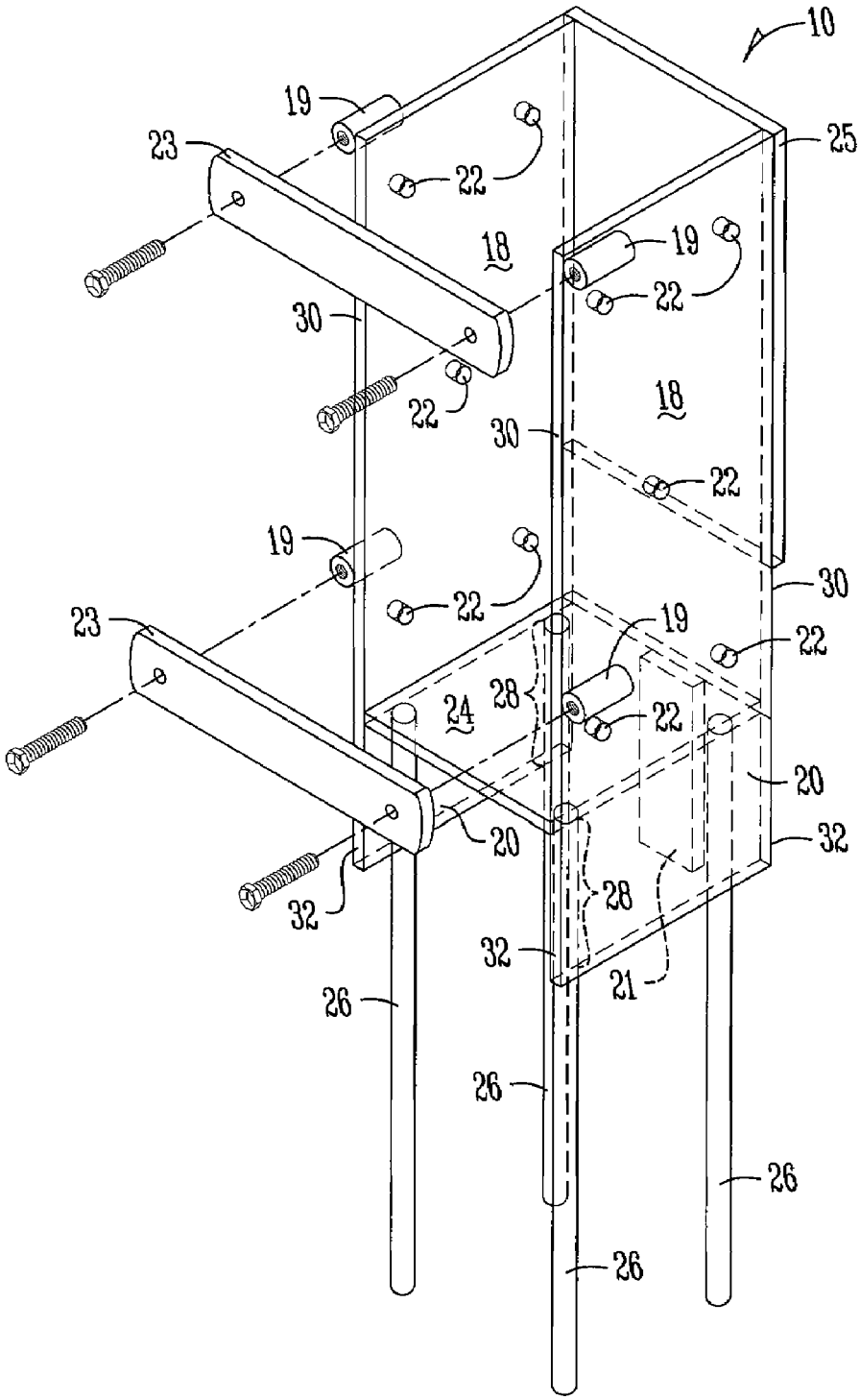
FIG. 2 is a perspective view of an exemplary embodiment of the present invention.
Figure 3:
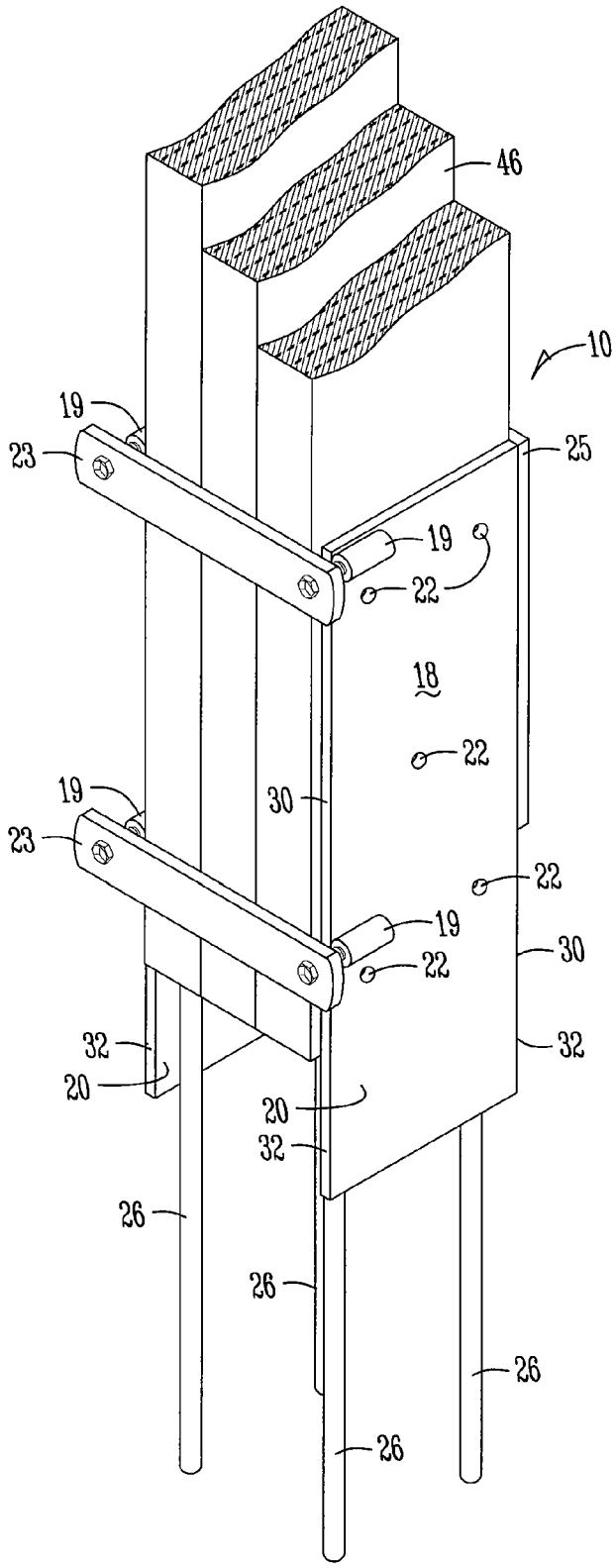
FIG. 3 shows another perspective view of an exemplary embodiment of the present invention.

FIG. 2 shows the preferred embodiment of the concrete post anchor 10 of the current invention. Similarly, FIG. 3 shows another view of the preferred embodiment of the concrete post anchor assembly 10 of the current invention. Additionally, other configurations may be used for this invention.

As seen in FIGS. 2 and 3, it is preferred that the concrete post anchor assembly 10 is constructed with two side brackets 18 oriented substantially parallel to one another and spaced apart with the use of a base bracket 24 and back bracket 25. It is preferred that the side brackets 18, the base bracket 24 and back bracket 25 be constructed from quarter-inch sheet steel. However, any other rigid material suitable for building can be used. It is preferred that the base bracket 24 and back bracket 25 be welded to the side brackets 18. However, the base bracket 24 and back bracket 25 can be bolted or otherwise fastened to the side brackets 18. Similarly, it is contemplated that the base bracket 24, side brackets 18 and back brackets 25 can be created from a single piece and formed to a shape. The side brackets 18 are preferred to be substantially parallel to one another to hold a building wall post 46. The base bracket 24 and back bracket 25 are preferred to be substantially perpendicular to one another to hold a building wall post 46. The back bracket 25 can fully or partially enclose the parallel space defined by the side brackets 18 and the base bracket 24.

The side brackets 18 are preferred to be configured with a side bracket tab 20. The side bracket tab 20 extends below the base bracket 24. The side bracket tab 20 and the side bracket 18 are preferred to be made from a single piece of quarter-inch sheet steel. However, the side bracket tab 20 can be welded on or otherwise affixed to the side bracket 18. Additionally, if the U-shaped bracket formed with two side brackets 18, one base bracket 24 and back bracket 25 are formed from a single piece, then the side bracket tab 20 can be welded near the point where the side bracket and the base bracket meet. Furthermore, if the U-shaped bracket is created from a single piece, the side bracket tab 20 can be created by laminating an entire second side bracket 18 which includes the side bracket tab 20 with the original side bracket 18. Other types, shapes and materials of side brackets 18, base bracket 24, back bracket 25 and side bracket tabs 20 and their assembly can be used for this invention.

The side brackets 18 are preferred to be configured having lugs 19. The lugs 19 are connected to the side brackets 18 by a weld, unitary construction or fastener. The lugs 19 are mounted on the outside of the side brackets. Lugs 19 are mounted to the side brackets 18 so that their forward-most face is collinear with the side bracket edge 30. In the preferred embodiment, a pair of lugs 19 are spaced apart and mounted on the outer surface of the two side brackets 18. Moreover, the lugs 19 are mounted on the same plane opposite one another on side brackets 18. For example, one lug 19 is connected on the outer surface near the top of one side bracket 18 and another lug 19 is mounted in the same position on the opposite side bracket 18. Alternatively, several lugs 19 may be mounted on each side bracket 18 and mirrored in position on the opposite side bracket 18. The lugs 19 may be constructed in such a way to support or hold a front bracket 23. For example, the front brackets 23 may be welded, fastened or hooked to the lugs 19. In the preferred form, the lugs 19 would be a nut for attaching the front brackets 23 to the side brackets 18 using a bolt.

An anchor tab 21 is attached to the base bracket 24. The anchor tab 21 extends perpendicularly away from the base bracket 24 in a direction opposite the U-shaped bracket. The anchor tab 21 may be a unitary piece with the U-shaped bracket, fastened or welded to the base bracket 24. The anchor tab 21 helps to stabilize the U-shaped bracket when embedded in concrete. The width of the anchor tab 21 may be constructed to traverse the total distance between the side brackets 18 or only a portion there between. By increasing the length of the anchor tab 21 or the distance the tab 21 extends away from the base bracket 24, helps increase the stability of the anchor 10. For example, the anchor tab 21 may extend a shorter distance, the same distance or a greater distance than the distance of the side bracket tabs 20 from the base bracket 24. In the preferred form, the anchor tab 21 is attached to the bottom and centered in the middle of the base bracket 24 and has a width less than the distance between the side brackets 18. The tab anchor 21 is preferably constructed of quarter-inch sheet steel.

When the concrete post anchor assembly 10 is used for building a building, the side bracket tabs 20 and tab anchor 21 should be embedded within a concrete pier 82. In the preferred configuration, side bracket edge 30 of the side bracket 18 are collinear with side bracket tab edge 32 of the side bracket tab 20, such that side bracket tab edges 32 extend away from the base bracket 24 ending in straight edges parallel to the base bracket 24. Similarly, the tab anchor 21 has edges extending in a perpendicular direction away from the base bracket 24 ending a straight edge parallel to the base bracket 24.

Other configurations, including angled or narrowing edges, may be used with this invention. For example, in order to reduce risk of the concrete pier 82 cracking, the side bracket tab 20 may have a side bracket tab edge 32 which is angled inward or narrowing with respect to the side bracket edge 30 of the side bracket 18.

The concrete post anchor assembly 10 also preferably has anchor rods 26 extending away from the base bracket 24. These anchor rods 26 are also to be embedded within a concrete pier 82 (shown in FIGS. 1 and 6-11) for use in constructing a building. The anchor rod 26 helps to hold the concrete post anchor assembly 10 securely within the concrete. To help to secure a concrete post anchor assembly 10, into the concrete, it is preferred that anchor tab 21 and side bracket tabs 20 also be embedded in the concrete pier 82. It is preferred that anchor rods 26 be constructed from one-half inch rebar (#4 bar size); however, other similar material can be used.

The anchor rods 26 can extend from either the base bracket 24, the anchor tab 21 or the side bracket tab 20, or from each. It is preferred, however, that the anchor rod 26 be welded with a lap-weld joint 28 to the side bracket tab 20. A lap-weld joint 28 creates a stronger connection with the anchor rod 26 over a standard butt-weld joint, which is commonly known in the art. However, any type of welding joint can be used for this invention as well as any other type of connecting means, thread joint, fasteners, etc., can be used for holding the anchor rod 26 to either the side bracket tab 20 or the base bracket 24.

The purpose of the concrete post anchor assembly 10 is to hold a building wall post 46. This is accomplished by tightening the front brackets 23 to the lugs 19, thereby enclosing and securing the building wall post 46 within the U-shaped bracket, as best illustrated in FIG. 3. FIG. 3 shows the front brackets 23 being securely bolted to the lugs 19 putting the building wall post 46 in compression against the back bracket 25. For example, the depth of the U-shaped bracket may be shallower than the building wall post 46 such that the building wall post 46 is not flush with the side bracket edge 30 or the front surface of each lug 19. Thus, when the front brackets are tightened down, the building wall post 46 is compressed against the back bracket 25. The building wall post 46 may be further secured in the post anchor assembly 10 using the side bracket apertures 22 shown in the side brackets 18. Any number of side bracket apertures 22 can be used. The side bracket apertures 22 are used to further fasten and secure the building wall post 46 to the concrete post anchor assembly 10. Generally, a building wall post 46 is inserted between the side brackets 18, and the front brackets 23 are secured to the side brackets 18 to secure the building wall post 46 in the U-shaped bracket. Then, if further securement is desired, a hole is preferably predrilled in the building wall post 46 in line with the side bracket apertures 22 to permit insertion of fasteners to hold the building wall post 46 to the anchor assembly 10. As shown in FIGS. 2 and 3, the side brackets 18 are configured with several apertures 22 on each side bracket 18. The placement of the apertures 22 create holes in opposing positions which are not in line with the grain of the lumber of the building wall post, thereby reducing chances for the building wall post 46 to split.

It is preferred that the building wall post 46 be a three-ply column wood laminate, such as 3-2×8 laminated #2 South Yellow Pine (SYP) boards. It is also preferred that lag screws be used as the fastener for further securing the post 46 to the anchor assembly 10 through side bracket apertures 22. Additionally, it is preferred that the lag screws or fasteners penetrate the center member of the laminate for maximum strength.

Other configurations to hold the building wall posts 46 can be used. One example, is using a through-bolt with apertures located opposite one another and a hole drilled through the building wall post 46. The through-bolts should be inserted through the holes and tightened with a nut, thereby connecting the side brackets 18 with the building wall post 46. However, this is not as strong as the fasteners being fastened part way into the building wall post 46. In fact, holes drilled through the building wall posts 46 may increase chances of splitting the posts 46. If this happens, the strength of the connection between the building wall posts 46 and the concrete post anchor assembly 10 depends on the tightness of the front brackets 23 and bolt or fastener and the friction on the side walls of the U-shaped socket for strength.

Figure 4:
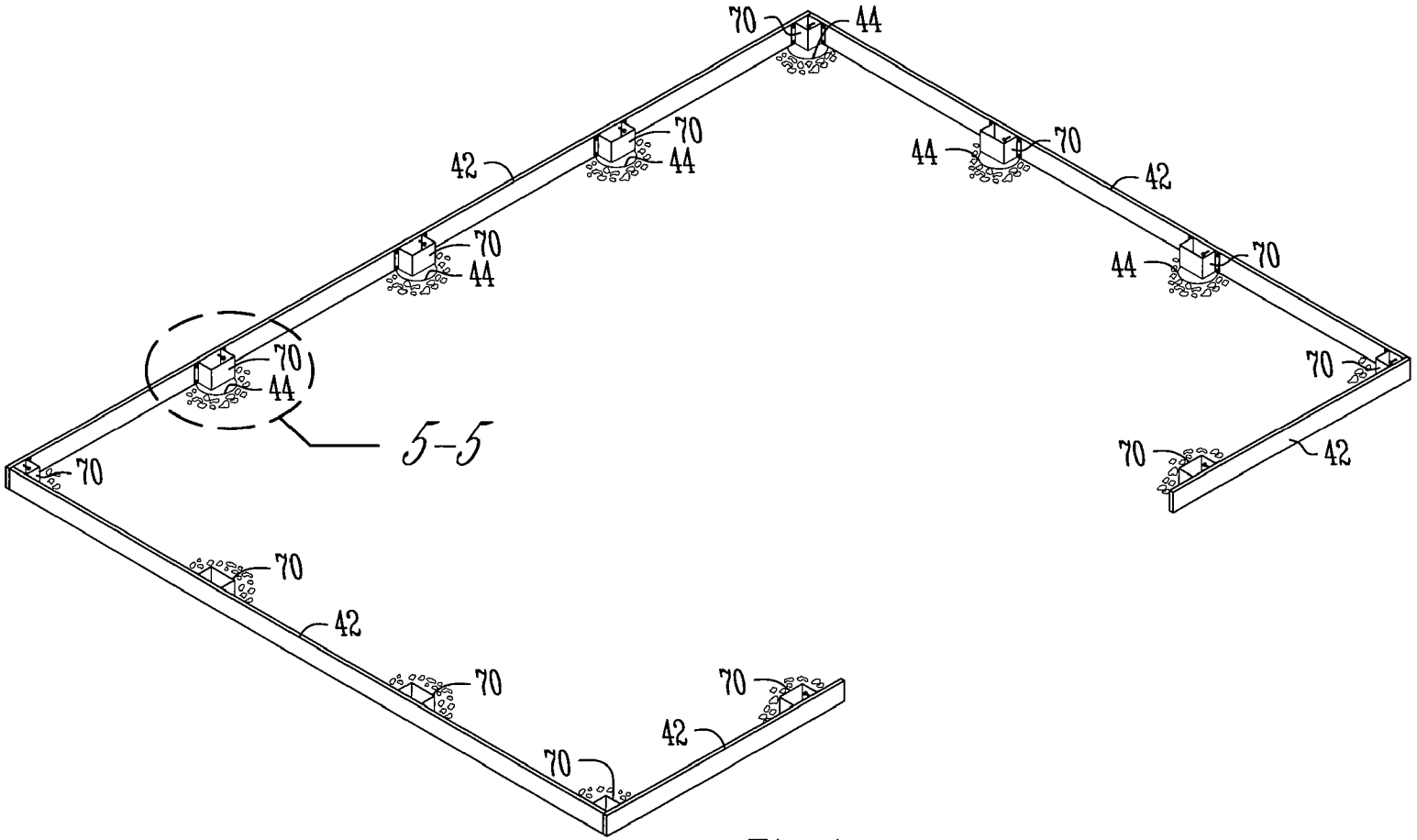
FIG. 4 shows the beginning stages of construction for one embodiment of a pole building using the current invention.

FIG. 4 shows the beginning steps of construction of a pole building. Once the building site is prepared, a baseboard frame 42 is constructed, preferably of treated 2×8 lumber, substantially around the perimeter of where the building is to be located. This baseboard frame 42 is generally a permanent part of the structure and should be leveled as is commonly known in the art. The baseboard frame 42 can be located and leveled with removable stakes or other similar method. Then, ground holes 44 are to be drilled in the ground. The holes 44 are preferably 12 inches in diameter and 48 inches deep, in the locations where building wall posts 46 are desired for supporting the building. Other size and depth of holes can be used as building size increases or decreases.

Figures 5, 5A:
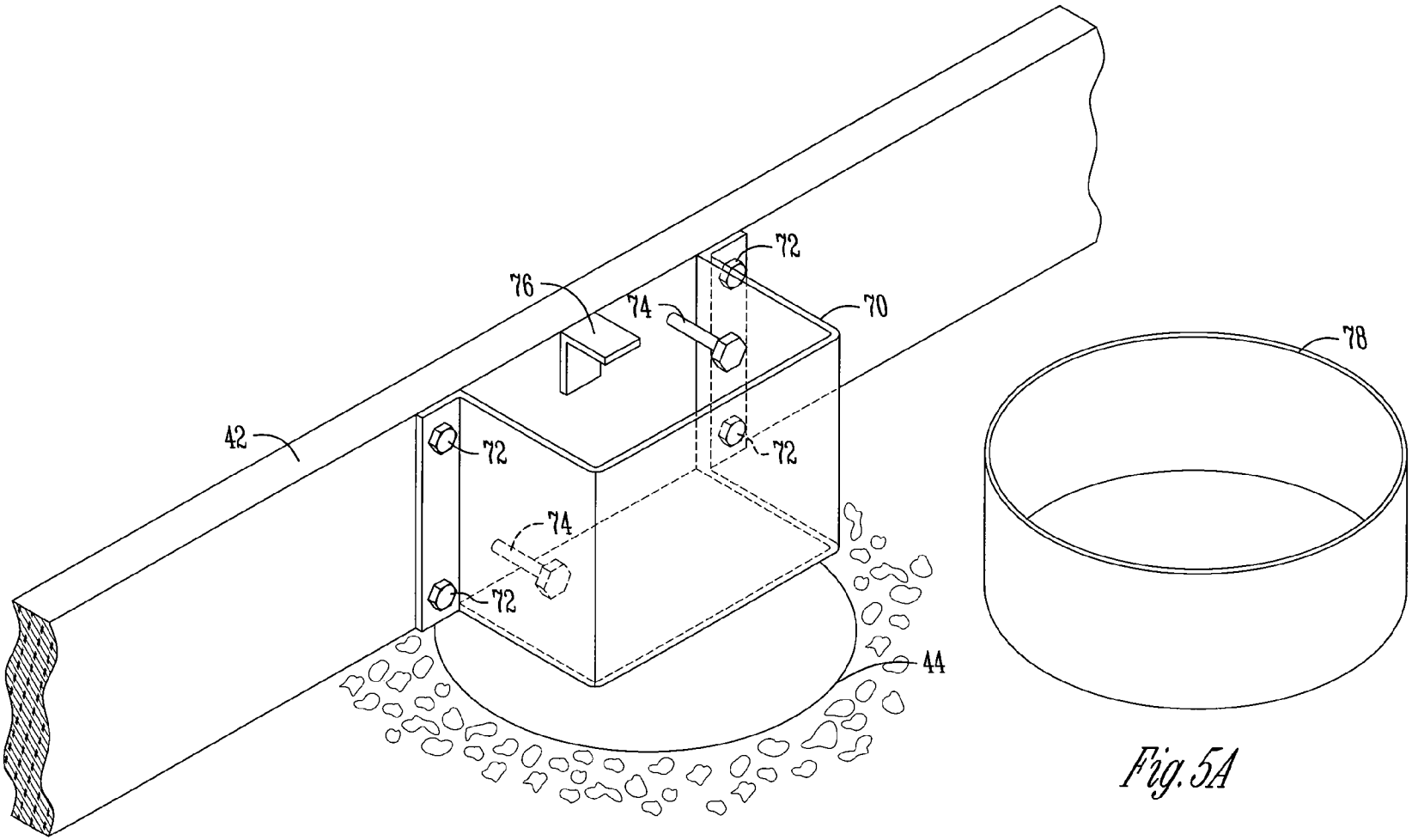
FIG. 5 is one embodiment of assembly using a pier form and baseboard mounting screws attached to the baseboard.
FIG. 5A is one embodiment of a concrete form tube.
Figure 6:
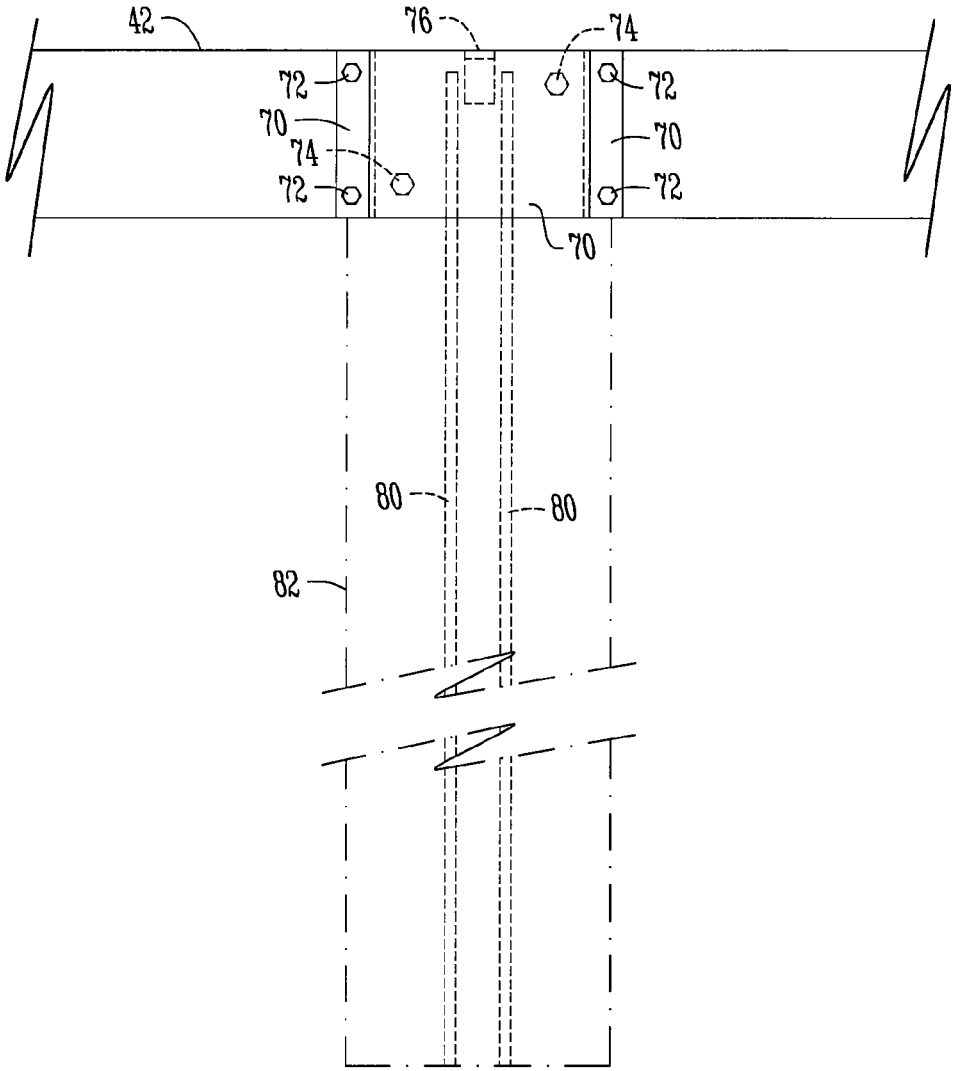
FIG. 6 is an elevation view of one embodiment of the concrete form detail.
Figure 7:
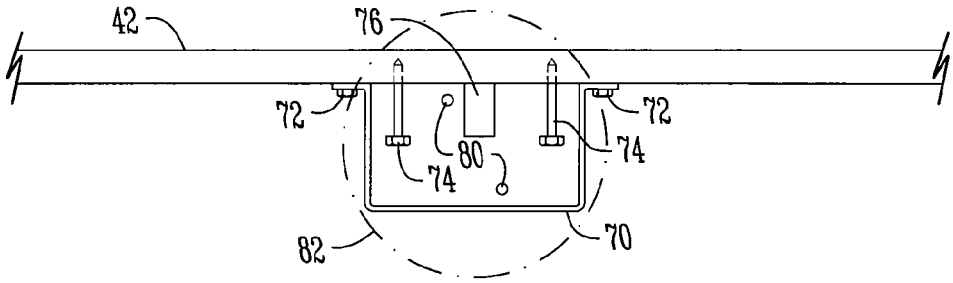
FIG. 7 is a plan view of one embodiment of the concrete form detail.

FIGS. 5, 6 and 7 show a preferred set-up for a concrete pier form 70. Once the ground holes 44 are created, it is preferred that baseboard mounting screws 74 be screwed into the baseboard 42 but not clear through the baseboard 42. These baseboard mounting screws 74 hold the baseboard 42 to the concrete pier 82 once the pier 82 is created, and are a permanent part of the building. Next, an anchor height bracket 76 can be fastened to the baseboard 42. The anchor height bracket 76 should be mounted level with the desired top of the concrete pier 82. Then, once concrete is poured, and the concrete post anchor assembly 10 is inserted into the concrete, the anchor height bracket 76 keeps the concrete post anchor assembly 10 from sinking in the uncured concrete. Finally, a concrete pier form 70 should be temporarily fastened with pier form fasteners 72 to the baseboard 42 in the locations where the concrete post anchor assemblies 10 are desired to support the building wall posts 46. The pier form 70 can be in any shape. Additionally, the pier form 70 can remain in place permanently or can be removed and reused, once the concrete is formed and cured. The top of the pier form 70 should also be located where the top of the concrete pier 82 is desired to be.

If the level of the soil is below the concrete pier form 70, a concrete form tube 78 shown in FIG. 5A can be used to essentially extend the ground hole 44 up to the base of the pier form 70 so as to create a continuous form with the pier form 70, the concrete form tube 78, and the ground hole 44 for the concrete to be poured into. There may be relatively horizontal openings where the form is not covered such that the uncured concrete will still cure properly. For instance, in FIG. 5, the ground hole 44 is located below the pier form 70. Therefore, the concrete form tube 78 can be placed below the pier form 70 and above the ground hole 44, thereby leaving a little bit of opening between forms since in this example, the pier form 70 is square shaped and the concrete form tube 78 is round.

Once all of the pier forms 70 are in place in the locations where the concrete post anchor assemblies 10 are to be used, concrete is to be poured into the ground hole 44, any necessary concrete form tube 78, and the pier forms 70. After the concrete has been poured, at least one sheer rod 80 is to be inserted into the uncured concrete and down through the pier form 70 and into the ground hole 44. The sheer rod 80 is preferred to be 32 inch long, half-inch diameter rebar. The purpose of the sheer rod 80 is to reduce chances of the concrete pier 82 sheering, should the concrete pier 82 receive a side impact, therefore, any size and length of similar material can be used.

After the concrete is poured, but before the concrete cures, the concrete post anchor assemblies 10 are to be inserted, anchor rods 26 and anchor tab 21 first, into the uncured concrete. The concrete post anchor assemblies 10 should be inserted in the concrete down to the level desired for the building wall post 46. This is aided by the anchor height bracket 76. Once the anchor assembly 10 is inserted, preferably with the base bracket 24 contacting the anchor height bracket 76, thereby imbedding the anchor rods 26, the side bracket tab 20 and the anchor tab 21 in the uncured concrete. Next, the concrete post anchor assembly 10 should be leveled to substantially plumb so that when a building wall post 46 is inserted into the concrete post anchor assembly 10, the building wall post 46 will be relatively plumb. However, the building wall post 46 can be leveled to substantially plumb even if the concrete post anchor assembly 10 is not leveled to plumb.

After all necessary concrete post anchor assemblies 10 are installed in the uncured concrete and preferably leveled to plumb, they are then to be left until concrete has sufficiently cured.

Figure 8:
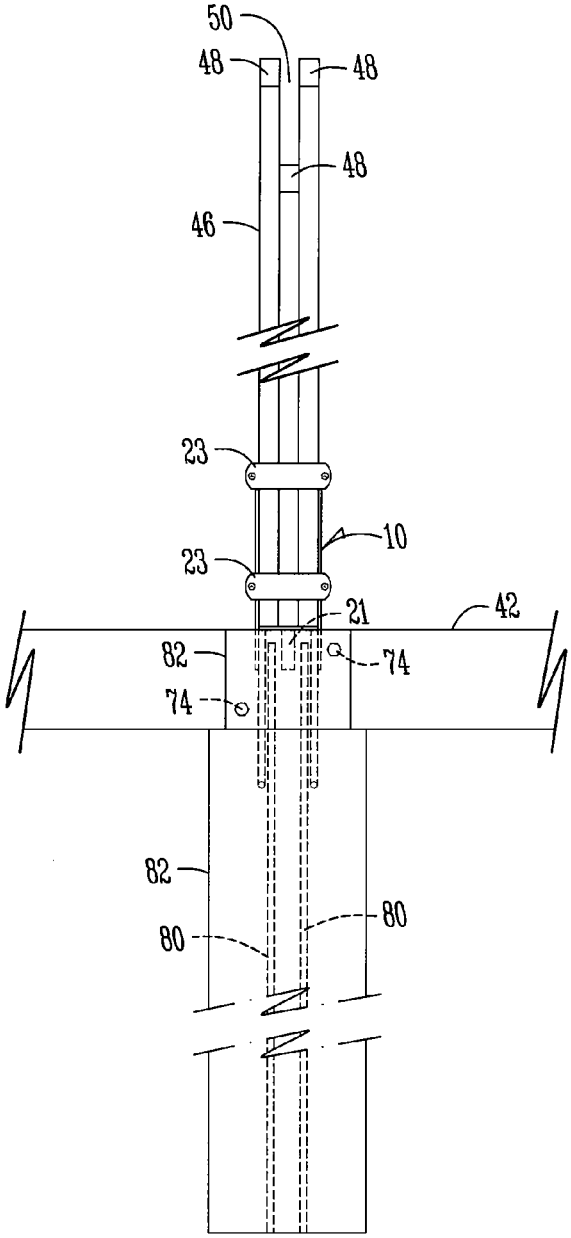
FIG. 8 is a front elevation view of one embodiment of a completed post/pier detail.
Figure 9:
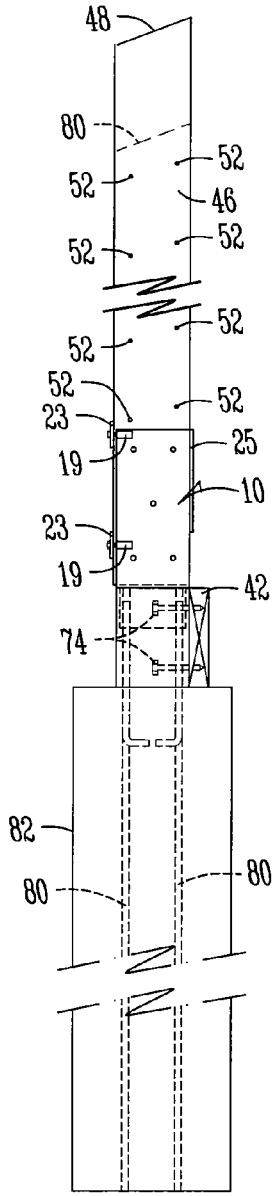
FIG. 9 is a side elevation view of one embodiment of a completed post/pier detail.
Figure 10:
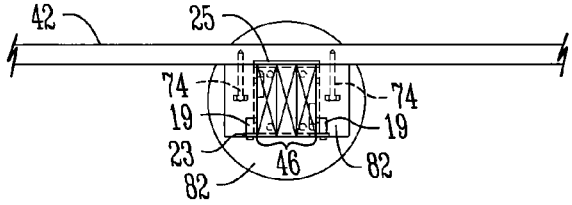
FIG. 10 is a plan view of one embodiment of a completed post/pier detail.

Once the concrete pier 82 has cured, the pier forms 70 can be removed, if desired, by removing the pier form fasteners 72. As seen in FIGS. 8, 9 and 10, the baseboard mounting screws 74 should now be embedded securely into the cured concrete pier 82 and thus hold the baseboard 42 securely in place and any temporary stakes holding the baseboard 42 can be removed. Now, any desired building wall post 46 can be inserted substantially vertically into the U-shaped bracket of the concrete post anchor assembly 10 and fastened thereto using the front brackets 23 and fasteners inserted through apertures 22. As discussed previously, it is preferred that a three-board laminate building wall post 46 be used for added strength to the building.

Since the concrete pier 82, the concrete post anchor assembly 10 and the building wall post 46 are all assembled separately on site, and the concrete post anchors 10 are leveled with the baseboard 42, the building wall posts 46 can be cut to length before installation. In other words, some other concrete post anchors which come with preformed concrete and post anchor assemblies are extremely heavy and hard to work with, and therefore are very difficult to get set on a uniform level grade for the building. Thus, on that type of assembly, the building wall posts 46 must be individually trimmed depending on how high they are with respect to level grade.

One benefit of having the laminated building wall post 46 precut is that the laminate boards can be cut with a wall post miter 48 as necessary to match the roof line of the building. Similarly, an advantage is the building wall post 46 with a laminate construction can have a wall post groove 50 for the roof support structure 60 to fit into for added support and strength. The building roof supports 60 can be beams, joists, trusses, or other similar type support devices.

As is known in the art, laminated building wall posts 46 are stronger than conventional solid wall posts. Part of what adds to the strength of the laminated wall posts 46 is the fact that multiple layers of material are layered and held securely together. It is preferred that these laminated layers be held together with multiple laminate fasteners 52 embedded on one side of the layer through a first layer and preferably into one or more other layers of the laminate. It is also preferred that this be done from both sides of the laminate layers. The laminate fasteners 52 can be nails, screws, or any other similar type device. In addition, the laminate layers can be held together with an adhesive for added strength.

Once the building wall posts 46 are put into place and leveled to substantially plumb, the building roof support beams 60 can be stretched across the desired building location between the building wall posts 46 as is customary in construction. Once this part is completed, the building frame assembly 40 should appear substantially as in FIG. 1.

Figure 11:
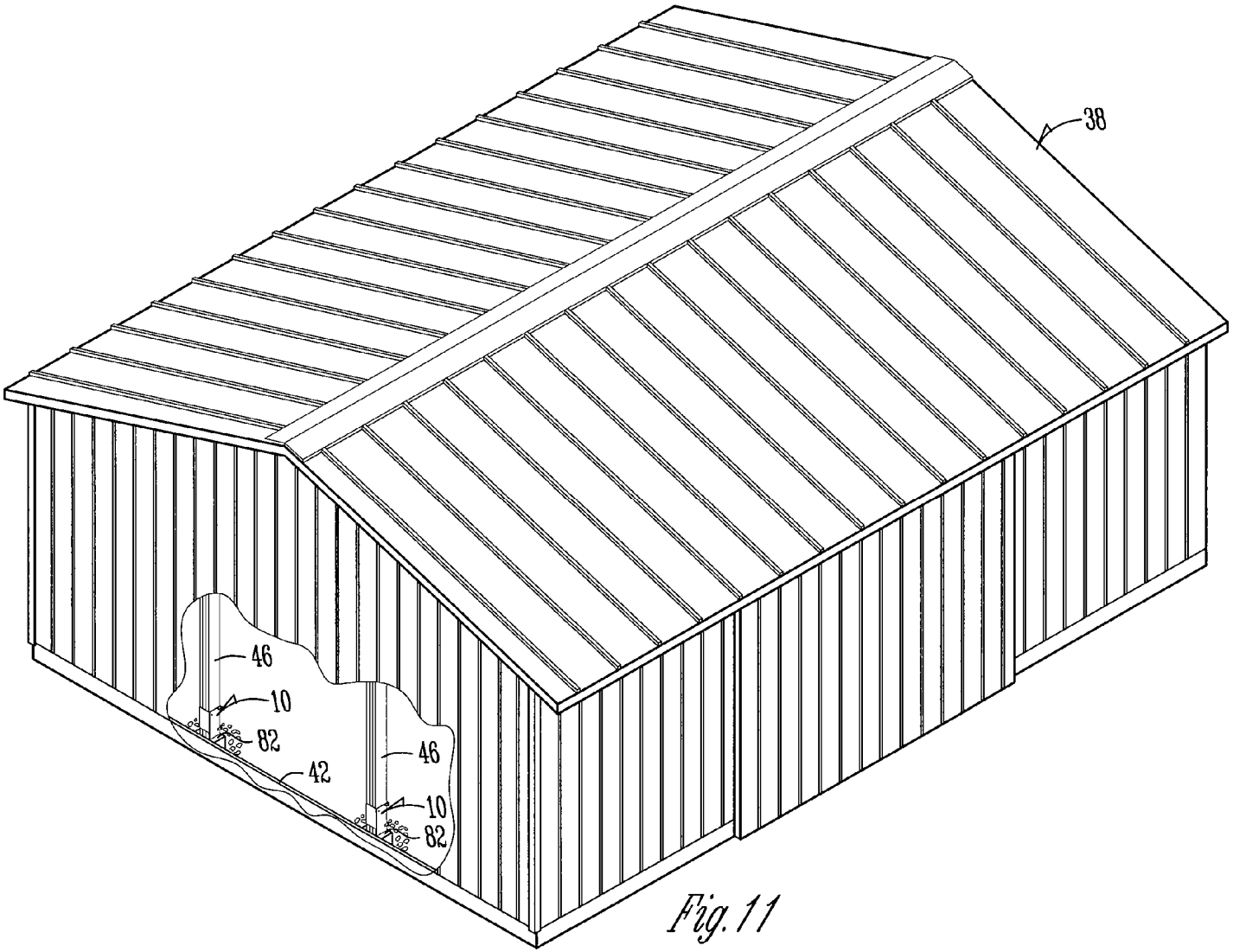
FIG. 11 is a perspective view of one embodiment of a pole building constructed using a current invention.

Once the building frame assembly 40 is completed, the roof and building walls can be sheeted and sided as necessary. One embodiment of a completed building assembly 38 is shown in FIG. 11.

The advantages of the current invention over the prior art are many. However, some notable advantages will be detailed below. Prior art pole buildings generally have wooden building wall posts directly in contact with the soil which causes a relatively short building life. On the other hand, the current invention does not have a building wall post 46 directly contact the soil therefore creating a substantially longer life building.

Other types of concrete post anchors are manufactured with large, preformed concrete bases attached to post anchors. These are extremely heavy, difficult to handle, expensive to ship, and nearly impossible to get set level and at the proper height without need for trimming the building wall posts. Conversely, the current invention has each step of construction done separately on the building site so that once the baseboard 42 is set level and at the proper height, the concrete post anchor assembly 10 can be embedded into uncured concrete to relatively the same level on baseboard 42 at each ground hole 44, thereby creating all of the concrete post anchor assemblies 10 at substantially the same level with respect to the grade for the building site. Thus, building wall posts 46 can be precut before installing, and therefore save time and money by having all of the building wall posts cut to the same height along the same wall of the building.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A concrete post anchor comprising:

a pair of substantially vertical side brackets;

the side brackets connected opposite one another and spaced apart with a base bracket and a back bracket to thereby form a U-shaped bracket;

at least one front bracket removably attached to the side brackets;

an anchor and a portion of the side brackets extend below the base bracket to thereby form an anchor tab and side bracket tabs; and a pair of anchor rods directly connected to each side bracket tab extending away from the base bracket in a direction opposite the U-shaped bracket.

2. The anchor of claim 1 wherein the anchor tab and the side bracket tabs extend away from the base bracket in a direction opposite the U-shaped bracket.

3. The anchor of claim 1 wherein the side brackets are welded to the base bracket and the back bracket.

4. The anchor of claim 1 wherein at least one pair of lugs are connected opposite one another on the outside surface of the side brackets.

5. The anchor of claim 4 wherein the at least one front bracket is bolted to the at least one pair of lugs to thereby anchor and secure a wall post to the anchor.

6. The anchor of claim 1 wherein the side brackets, the base bracket and the back bracket are of unitary construction.

7. The anchor of claim 1 wherein the side brackets are substantially parallel to one another.

8. The anchor of claim 1 wherein the side brackets are configured with a plurality of side bracket apertures to allow for fastening to a wall post.

9. The anchor of claim 8 wherein a first aperture of the plurality of side bracket apertures is located in a diagonal relationship to a second aperture of the plurality of side bracket apertures to prevent splitting of a post when fasteners are inserted into the wall post.

10. The anchor of claim 1 wherein the pair of anchor rods are welded with a lap joint to the side bracket tab.

11. The anchor of claim 1 wherein the anchor tab, the side bracket tab and the anchor rod extend into a concrete pier, the concrete pier being formed at a building site where the anchor is being used for constructing a building.

12. A pole building on a building site comprising:

a floor, sidewalls, and a roof;

the roof supported by roof supports;

the roof supports supported by wall posts;

the wall posts supported by a concrete post anchor;

the concrete post anchor comprising a pair of substantially vertical side brackets;

the side brackets operatively connected opposite one another and spaced apart with a base bracket and a back bracket to thereby form a U-shaped bracket having a partially enclosed back side;

a pair of front brackets removably attached to the side brackets;

a portion of the side brackets extend below the base bracket forming a side bracket tab; and at least one anchor rod directly connected to each side bracket tab so as to extend away from the base bracket in a direction opposite the U-shaped bracket.

13. The building of claim 12 wherein an anchor tab is connected to the base bracket on the partially enclosed back side so as to extend below the base bracket in a direction opposite the U-shaped bracket.

14. The building of claim 12 wherein the concrete post anchor extends upward from and is embedded into a concrete pier.

15. The building of claim 14 wherein concrete is poured and formed in the concrete piers on the building site for supporting the concrete post anchor.

* * * * *